United States Patent [19]

Simmons

[11] Patent Number: 4,800,015

[45] Date of Patent: Jan. 24, 1989

[54] UTILIZATION OF LOW RANK COAL AND PEAT

[76] Inventor: John J. Simmons, P.O. Box 1971, Bismarck, N. Dak. 58502

[21] Appl. No.: 63,124

[22] Filed: Jun. 17, 1987

Related U.S. Application Data

[62] Division of Ser. No. 848,166, Apr. 3, 1986, Pat. No. 4,705,533.

[51] Int. Cl.[4] ..... C10M 175/00

[52] U.S. Cl. ..... 208/180; 44/502; 208/179

[58] Field of Search ..... 208/179, 180, 299, 300, 208/424, 428, 434; 44/51, 1 G, 6, 33, 51, 502

[56] References Cited

U.S. PATENT DOCUMENTS

| | | | |
|---|---|---|---|
| 1,868,732 | 7/1932 | Dubbs | 208/434 |
| 3,458,588 | 7/1969 | Meyer et al. | 208/179 |
| 4,227,995 | 10/1980 | Sze et al. | 208/251 H |
| 4,306,960 | 12/1981 | Gleim | 208/434 |
| 4,334,976 | 6/1982 | Yan | 208/251 H |
| 4,422,922 | 12/1983 | Rosenthal et al. | 208/251 H |
| 4,551,234 | 11/1985 | Hellinger, Jr. | 208/179 |
| 4,705,533 | 11/1987 | Simmons | 44/51 |

FOREIGN PATENT DOCUMENTS

| | | | |
|---|---|---|---|
| 0048098 | 3/1982 | European Pat. Off. | 208/254 A |

*Primary Examiner*—Curtis R. Davis

*Attorney, Agent, or Firm*—Vidas & Arrett

[57] ABSTRACT

Low rank coals including lignite, brown and subbituminous coals, and peat containing unacceptably high quantities of water are dried and enriched in BTU content. The mined low rank coal is crushed to between about one-half inch and three inches in diameter and immersed in hot oil to dry the coal. The coal is then screened or centrifuged to remove excess oil and the resulted oil impregnated dried coal has a much higher BTU content. The dried high BTU low rank coal may be then powdered and utilized to form a coal-water liquid fuel.

1 Claim, No Drawings

UTILIZATION OF LOW RANK COAL AND PEAT

This is a division, of application Ser. No. 848,166, filed Apr. 3, 1986 now U .S. Pat. No. 4,705,533.

I. DESCRIPTION

Field of the Invention

This invention relates to methods of drying low rank coal and peat with oil, dry compositions produced thereby and stabilized aqueous slurries of dried, low rank coal or peat.

Background of the Invention

Low rank coals include carbonaceous fuels such as lignite, brown coal, and sub-bituminous coal. Each of these low rank coals contain undesirably high quantities of water. Peat is a carbonaceous fuel which also has a high internal water content. This problem is common to all coals, although in higher grade coals, such as anthracite and bituminous coals, the problem is less severe because the water content of such coal is normally lower and the heating value is higher.

Low rank coals and peat as produced typically contains from about 20 to about 65 weight percent water. While many of these coals and peat are desirable as fuels and may be very abundant, the use of such lower grade coals and peat as fuel has been greatly inhibited by the fact that they contain a high percentage of water. The attempts to dry such coal or peat for use as a fuel have been inhibited by the tendency of such coals after drying to undergo spontaneous ignition and combustion in storage, transit and the like.

The drying required with such low rank coals and peat must remove both the surface water plus the large quantities of interstitial water present. In contrast, when higher grade coals are dried, the drying is commonly for the purpose of drawing the surface water from the coal particle surfaces but not interstitial water, since the interstitial water content of the higher rank coals is relatively low. Coal drying processes involving higher grade coals utilize much lower heating temperatures and such coal leaving the dryer will often have temperatures below about 110 degrees F (45 degrees C). By contrast, processes for the removal of interstitial water require longer residence times and result in heating the interior portions of the coal or peat particles. The coal leaving a drying process for the removal of interstitial water will typically be at a temperature from about 0 degrees to about 250 degrees F (54 to 121 degrees C). The resulting dried coal or peat has a strong tendency to spontaneously ignite upon storage, during transportation and the like and also tends to crack, break up, and disintegrate very easily forming a fine, explosive dust.

It is highly desirable that low rank coals and peat be available for use more widely than has been possible at the present. Low rank coals and peat typically have a relatively low sulfur content which is a highly desirable property. Large deposits of low rank coal and peat are found throughout the world and remain a largely untapped energy source. However, large amounts of water within the low rank coals and peat means that when the fuel is shipped and burned because of its desirable low sulfur content, freight charges will involve the shipment of a great deal of water. In cold climates, the frozen low rank coal and peat is very difficult to transport as it freezes and adheres to both railroad cars and transfer facilities. The heating value is also much lower than high rank coal since a substantial portion of the fuel is water rather than combustible carbonaceous material. Since many furnaces are not adapted to burn such lower heating value fuels, low rank coals and peat are typically not being utilized or when used, result in substantially lower heating boiler capacities and efficiencies. However, when the water content is reduced the heating value is raised since a much larger portion of the fuel then comprises combustible carbonaceous material.

Others have tried to dry low rank coal to remove interstitial water. In Fisher, et al, U.S. Pat. No. 4,354,825, coal is dried with a hot gas to about 200 degrees F (93 degrees C.) and cooled quickly to decrease the risk of fire. After cooling, the coal is sprayed with an oil to decrease the oxidation rate.

In Ishizaki, et al, U.S. Pat. No. 4,203,729, methods for roducing coal dispersing oil compositions are described in which high moisture content coals are dried after first being milled to a fine powder. The powder is mixed with a petroleum oil and heated to between about 100-150 degrees C. (212-300 degrees F). The finely milled powder is quickly dehydrated since the interstitial water is close to the coal surface.

In Li, et al, U.S. Pat. No. 4,396,394 low rank coals are heated with a hot gas until dried and are then subjected to a cooling zone. The dried coal may be partially oxidated prior to cooling and may also be deactivated by contacting the dried coal with a suitable deactivating fluid. Deactivating fluids are described in Skinner, et al, U.S. Pat. No. 4,396,395.

Brief Summary of the Invention

Low rank coals including, lignite, brown and sub-bituminous coals as well as peat having high moisture contents are dried to decrease the water content and to increase the BTU content. The coal as mined is crushed so that the maximum particle size is no greater than three inches in diameter. In the case of peat, it is harvested as chunks or pressed into pellets. Preferably, the mean particle size is between one-half inch and three inches in diameter and most preferably between about one-half inch and one inch in diameter.

The coarse milled low rank coal or harvested peat is then immersed in oil and heated to a temperature of between about 300–440 degrees F. (150–227 degrees C.) During the heating process, the used oil penetrates and coats the low rank coal or peat particles and partially replaces the expended moisture. The coating not only protects the material from oxidation and spontaneous combustion but improves burning qualities by increasing the BTU content.

After the moisture is removed to below about five percent by weight the oil is drained for recycling by screening or centrifuging.

After screening and or centrifuging, the hot material is preferably placed in a separate insulated container where its latent heat tends to drive off any remaining moisture and low and medium volatile oils. Additional heat may be added to further reduce the oil content. Enough oil must remain on the low rank coal or peat to prevent oxidation and spontaneous combustion. Initial heating at a higher temperature of 400–450 degrees F. (204–232 degrees C.) reduces the drying time and provides more latent heat needed to expel the lower volatile oils from the coal or peat.

After cooling, the dried low rank coal or peat product typically has a value of between about 9,000 to over 13,000 BTUs per pound and may be shipped directly or may be finely ground and further processed into coal-oil or coal-water mixture fuels. It must be understood that "coal" as used herein may include dried peat having an increased BTU content.

Water vapor and oil vapors exiting the drying unit are preferably passed through a condenser and then through a water-oil separator. The oil can then be further processed into a separate re-refined high quality oil byproduct or recycled to the drying system. When waste oil or other high temperature distillation point oils are used, the steam probably doesn't contain large enough quantities of oil vapor to warrant the use of a condenser.

Oil vapor exiting the second conditioning reaction unit is preferably passed through a separate condenser, as very little water vapor is now present. This condensed oil is then further processed by methods known in the art to a high quality oil byproduct.

The dried, oil-coated low rank coal or peat is protected with a thin film of oil which has completely penetrated each particle such that it will absorb little water but can be used to form a stable aqueous or oil suspension. The coal-water liquid fuel of the invention comprises an aqueous suspension of such dried, oil coated low rank coal or peat. The liquid fuel is obtained by grinding the oil-coated, dried low rank coal or peat to about 75% minus 200 mesh or less. A suspension stabilizing agent, which is preferably a water gel absorbing agent such as a hydrolyzed, saponified starch graft polymer of poly-acrylonitryl such as is disclosed in U.S. Pat. No. 3,997,484, is added.

A typical coal-water mix would contain 44–70% coal, 29–55% water, 1–5% oil, and no greater than about 0.5% suspending agents. The liquid fuel thus prepared may be utilized with minor burner changes in furnaces which previously burned heavy residual fuel oil.

Detailed Description of the Invention Coal and Peat Drying

EXAMPLE 1

Raw, air dried sod-peat sized to pass a two inch screen from St. Louis County, Minnesota, containing approximately 35% moisture and 5,500 BTUs per pound was immersed in used automobile crank case oil heated to 400 degrees F. (240 degrees C.). After heating for 12 minutes, the sodpeat was screened to remove the excess oil and allowed to cool slowly in a separate insulated container. Oil volatiles continued to be emitted until the temperature of the peat cooled to about 240 degrees F. (116 degrees C.). The dried peat was then analyzed and was found to have a BTU per pound of 11,449 and a sulfur value of 0.43. The above product was black instead of brown and completely penetrated with a thin film of used oil. A part of the product was placed in a separate container and ignited. The burn continued to completion and the remaining ash was weighed. The ash content was 7.3%. The low sulfur value would qualify the product as a premium low sulfur fuel.

It has been found that due to the fibrous, fine grain nature of peat, the drying differs from that of both lignite and sub-bituminous coal. The drying time in response between peat sod and pelleted and milled peat also differed. The peat pellets required a longer drying period than the sod or milled peat. The pelleted peat produced a superior handing product. It was also found that if the peat is first pressed into a pellet, the moisture could be removed with only a slight loss of strength or size of the original pellet.

Peat is not a low rank coal. Those in the art do not consider peat to be a low rank coal due in part to its chemical, physical and handling differences. However, its low BTU content and high moisture content make peat a prime candidate for the methods of this invention.

With the methods of this invention, peat containing moistures as high as 60% and BTU levels of about 3,500 per pound may be dried to a high energy product containing less than three percent moisture and in excess of 10,000 BTUs per pound. Enriched dried fuel has a substantially reduced susceptibility to spontaneous combustion with considerably less decrepitation and dust. Shipping under freezing conditions is not a problem as the product contains less than three percent moisture.

EXAMPLE 2

Velva lignite coal containing 36% moisture and having a heating content of 6,550 BTUs per pound was crushed to less than one inch in diameter. Waste automobile crank case oil was collected and filtered and used as a hot oil medium for drying this low rank coal. The coal was dried in the hot oil medium at a temperature of about 325 degrees F. (165 degrees C.) which reduced its moisture level to approximately three percent. The heat content was increased from 6,550 tp 10,070 BTUs per pound.

EXAMPLE 3

In order to further reduce the amount of oil retained in the coal or peat, the dried low rank coal or peat may be heated in a separate unit to a temperature that will volatilize up to 75% of the remaining oil. Typically, 6–8% of the original oil remains in the hole after screening, centrifuging or pressure filtering and this volatilization process will further reduce the oil content to about 1.5–4%.

The volatilized oil is preferably collected in a cooling unit and returned to the original hot oil tank. Waste oil, No. 5 or No. 6 fuel oil or oil containing a high percentage of higher temperature volatiles is preferably added as a make-up oil to replace the oil retained by the coal or peat.

After the dried, oil-coated low rank coal or peat is screened, the hot material was placed into a separate insulated bin or container where its latent heat tends to drive off any remaining moisture and low and medium volatile oils. Additional heat may be added to further reduce the oil content to between 1.5–4% which is enough oil to prevent oxidation and spontaneous combustion. Initial heating at a higher temperature of 400 to 450 degrees F. (204–232 degrees C.) reduces the drying time and provides more latent heat needed to expel the lower volatile oils from the coal or peat.

EXAMPLE 4

The quantity of oil retained by the dried coal or peat can be reduced by removing the coal or peat from the hot oil medium while water vapor is still exiting from the drying coal particles. The exiting steam reduces the amount of oil that can penetrate the cracks and interstices of the low rank coal or peat. The drying time wil vary depending on the type, porosity and particle size.

A Velva lignite containing 36% moisture and 6600 BTU /lb. was crushed to 100% minus 1 inch and immersed in waste oil heated to a temperature of 350 degrees F. (177 degrees C.) One-half (Sample A) of the coal was removed after 10 minutes, drained and screened to remove the excess oil. The oil content was 8%. The remaining onehalf (Sample B) was removed from the hot oil medium after 16 minutes, drained and screened. The oil retained in the coal was 12%.

Sample A was further heated in air to 425 degrees F (218 degrees C.) for 10 minutes which volatilized a portion of the oil to leave a final oil content of approximately 3% which was sufficient to protect the coal from spontaneous combustion. Sample B was heated to 425 degrees F. (218 degrees C.) for 10 minutes and the entrained oil content reduced only to 8%.

It is important to control the time and temperature of the oil bath to reduce the amount of residual oil remaining in the final product.

While the water is exiting the coal or peat particles, very little oil penetrates the particle against the pressure of this exiting steam. However, once a major portion of the water is expelled or volatilized as steam, the surrounding oil enters and fills the voids left by the exited water. Some cell collapse occurs and a smaller percentage of oil (usually less than 15%) enters the coal than the amount of water that exited which is usually from 20 to 55%. In the case of peat, up to 25% oil replaces the original 40–65% water in the raw, undried peat.

The observation that only a small amount of oil will enter the coal or peat while the water is exiting as steam is important in controlling the total amount of oil that remains in the final dried coal product. It is desirable to retain sufficient oil to protect the coal from subsequent oxidation and spontaneous combustion (2 to 5%) and yet not leave an excessive amount of oil since the additional cost of excess oil can be prohibitive enough to make the final product non-economic. The coal or peat is, therefore, preferably removed from the hot oil bath while steam is still exiting from the majority of more than 50% of the coal or peat particles. This drying time will vary dependent on type, porosity, and particle size and can be easily controlled by those skilled in the art given the teachings of this specification.

EXAMPLE 5

It was found tat when a low rank coal is crushed to a powder, the drying time is almost instantaneous. However, it is much more difficult to remove the excess oil from the fine coal than from coarse coal so that the benefits of this inventions are reached only when the coal or peat to be dried is initially crushed to not less than a mean particle size of about one-fourth to one-half inch in diameter. Crushing beyond that level may increase the speed of drying but also greatly increases the risk of spontaneous combustion prior to the drying process.

The actual heating of the oil and untreated, crushed low rank coal or peat may be carried out by burning the fines which are produced in the crushing process. Alternatively or addi- . tionally conventional liquid fuels may be used to heat the oil and coal.

It was also found that drying peat or other low rank coals in used or waste oil cause substantial foaming whereas drying the same materials in oil such as a number 2 fuel oil or vegetable oil resulted in little or no foaming. The foaming action may be accommodated for by designing the drying unit with suitable overflows and or skimmers to remove the foam which is preferably recycled. The foaming action can also be controlled by designing the drying reaction unit with enough head room above the hot oil bath to prevent overflowing, or by adding commercial oil de-foaming agents known to those familiar with the art.

EXAMPLE 6

The preparation of a coal-water liquid fuel may comprise an aqueous suspension of dried oil-coated peat, lignite, brown or sub-bituminous coal. The low rank coal is crushed to a coarse grind (mean particle size greater than one-fourth inch and less than three inches) and immersed in an oil such as a fuel oil, crude oil, mineral oil, vegetable oil, palm oil or waste, used oil. In the case of peat, it is extruded into sod chunks or pressed into pellets having a mean particle size of greater than ½ inch less than about three inches in diameter. The coal or peat is then dried by heating the coal or peat in oil to a temperature of between 325 degrees F (163 degrees C) and 440 degrees F (227 degrees C) until a moisture content of less than about 5% by weight is achieved. The excess oil is then removed.

The dried oil coated coal or peat is then ground to about 75% minus 200 mesh, although a much finer grind is made of the end products is to be burned in a diesel engine. A suspension stabilizing agent is preferably then added and sufficient water is added to form a stable, pumpable gel which is an effective fuel for furnaces, power plants and the like. Preferably, the absorbing agent will be a hydrolyzed, saponified starch graft polymer of poly-acrylonitryl such as is disclosed in U.S. Pat. No. 3,997,484. A typical lignite water fuel would contain from about 45–70% lignite, about 2–15% oil, about 0.25–075% of the suspending agent, 0.10 to 0.02% of anionic surfactants such as sodium stearate or agents such as alkyl phosphates, alkyl sulfates or alkane sulfuric acids and about 20–50% water.

The surfactants may be selected from industrial and home detergents. Even home detergents such as these marked under the brand name Liquid Tide and Vel may be utilized with good results. A few drops of detergent per liter of the coal-water fuel will substantially reduce the viscosity of the slurry.

The coal-water fuel may also include as a suspension other beneficial additives including finely divided lime to combine with sulfur for a reduced $SO_2$ omissions, ash modifying additives such as Titania, Zirconia or Magnesium or Calcium Oxides to increase the ash melting point. Ash modifiers including Bentonite or Hectorite Clay may also be added.

The utilization of used or waste oil to produce enriched, high BTU fuels and high value rerefined oil from high moisture, low value fuel products such as peat, lignite, brown and subbituminous coal represents a unique and novel method of utilizing potential pollutants and low value natural resources. The invention utilizes coarse milled low rank coal rather than finely milled coal in order to prevent the problems associated with fine coal such as explosion, spontaneous combustion decrepitation and excessive dusting. The dried, oil-coated low rank coal and peat may be readily shipped without the added shipment costs incurred by shipping large quantities of water. Also, the large mean particle size of the dried coal or peat enables the fuel to be shipped much more readily and easily than dried powdered coal.

In considering this invention it must be remembered that the disclosure is illustrative only and that the scope of the invention is to be determined only by the appended claims.

What is claimed is:

1. A method for utilizing waste oil to produce an enriched fuel and re-refined oil comprising:

(a) obtaining a previously used oil;

(b) immersing a low rank coal which has been previously crushed to a mean particle size of between about ½ and 1½ inches in diameter in said oil;

(c) heating the oil coated mixture to a temperature of between about 300 to 400 degree F. (149–227 degrees C.) to dry said coal;

(d) screening and/or centrifuging the oil coated coal to allow excess oil to drain from said coal;

(e) heating the oil coated coat between about 350–500 degrees F. (177–260 degrees C.) to further reduce the oil content of the oil coated coal which is now an enriched fuel; and (f) condensing the resulting water and oil vapors and separating the condensed products in a water-oil separator in order to obtain a rerefined condensed oil.

* * * * *

UNITED STATES PATENT AND TRADEMARK OFFICE

CERTIFICATE OF CORRECTION

PATENT NO. : 4,800,015

DATED : January 24, 1989

INVENTOR(S) : John J. Simmons

It is certified that error appears in the above-identified patent and that said Letters Patent is hereby corrected as shown below:

Col. 1, line 49, "0" should be deleted and "130" inserted

Col. 2, line 18, "roducing" should be deleted and "producing" inserted

Signed and Sealed this

Twenty-fifth Day of July, 1989

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,800,015

DATED : January 24, 1989

INVENTOR(S) : John J. Simmons

It is certified that error appears in the above-identified patent and that said Letters Patent is hereby corrected as shown below:

Col. 1, line 49 delete "O" and insert - 130 -

Col. 2, line 18, delete "roducing" and insert - producing -

Col 5, line 49, delete "tat" and insert - that -

Col. 5, line 63, delete "addi-.tionally" and insert - additionally -

This certificate supersedes Certificate of Correction issued July 25, 1989

Signed and Sealed this

Twenty-second Day of August, 1989

*Attest:*

DONALD J. QUIGG

*Attesting Officer*

*Commissioner of Patents and Trademarks*